US008077829B2

(12) United States Patent
Moore et al.

(10) Patent No.: US 8,077,829 B2
(45) Date of Patent: Dec. 13, 2011

(54) ELECTRON EMITTER APPARATUS AND METHOD OF ASSEMBLY

(75) Inventors: Paul D. Moore, Salt Lake City, UT (US); Christopher F. Artig, Summit Park, UT (US); Robert C. Treseder, Burton, WA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 471 days.

(21) Appl. No.: 12/238,214

(22) Filed: Sep. 25, 2008

(65) Prior Publication Data

US 2010/0284519 A1 Nov. 11, 2010

(51) Int. Cl.
*H01J 35/06* (2006.01)

(52) U.S. Cl. ..... 378/136

(58) Field of Classification Search ..... 378/119, 378/121, 138, 136; 313/326, 340, 341, 345
See application file for complete search history.

(56) References Cited

U.S. PATENT DOCUMENTS 5,170,422 A * 12/1992 Fiebiger ..... 378/136
2010/0195797 A1* 8/2010 Hauttmann ..... 378/136

* cited by examiner

*Primary Examiner* — Irakli Kiknadze
(74) *Attorney, Agent, or Firm* — Maschoff Gilmore & Israelsen

(57) ABSTRACT

An electron emitter assembly, and methods of assembly, is disclosed. The emitter assembly includes an electron emitter that is secured to a support device in a manner such that the emitter is substantially thermally isolated from the support device.

42 Claims, 8 Drawing Sheets

ELECTRON EMITTER APPARATUS AND METHOD OF ASSEMBLY

BACKGROUND

1. The Field of the Invention

Embodiments of the present invention relate generally to electron emitters and their methods of assembly. More particularly, disclosed embodiments are directed to electron emitter assemblies suitable for thermionic emission of electrons for x-ray generation.

2. The Relevant Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure that contains a cathode assembly and an anode assembly. The vacuum enclosure may be composed of metal such as copper, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition, a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the electron source by the process of thermionic emission. An electric potential on the order of about 4 kV to over about 200 kV is applied between the cathode and the anode in order to accelerate electrons boiled off the electron source toward the target surface of the anode assembly. X-rays are generated when the highly accelerated electrons strike the target anode surface.

Most of the electrons that strike the anode dissipate their energy in the form of heat. Some electrons, however, interact with the atoms that make up the target and generate x-rays. The wavelength of the x-rays produced depends in large part on the type of material used to form the anode surface. X-rays are generally produced on the anode surface through two separate phenomena. In the first, the electrons that strike the anode surface carry sufficient energy to "excite" or eject electrons from the inner orbitals of the atoms that make up the target. When these excited electrons return to their ground state, they give up the excitation energy in the form of x-rays with a characteristic wavelength. In the second process, some of the electrons from the cathode interact with the atoms of the target element such that the electrons are decelerated around them. These decelerating interactions are converted into x-rays by conservation of momentum through a process called bremsstrahlung. Some of the x-rays that are produced by these processes ultimately exit the x-ray tube through a window of the x-ray tube, and interact with a patient, a material sample, or another object.

Generating a tightly collimated x-ray beam for diagnostic purposes can be achieved by maximizing both x-ray flux (i.e., the number of x-ray photons emitted per unit time) and the focusing of the electron stream on the anode surface in order to produce a tightly collimated x-ray beam. Diagnostic image quality is at least partially a function of the number of electrons that impinge upon the target surface of the target anode. In general, more electrons results in higher x-ray flux, which in turn results in x-ray images with higher contrast (i.e., higher quality). In addition to emitter efficiency, the quality of diagnostic images can additionally depend on the pattern, or focal spot, created by the emitted beam of electrons on the target surface of the target anode. In general, a smaller focal spot produces a more highly focused or collimated beam of x-rays, which in turn produces better quality x-ray images.

In conventional x-ray tube designs, it is often difficult to achieve an optimal electron beam emission, due to a number of design constraints and tradeoffs. For example, emitter assemblies that utilize a planar emitter structure are desirable because such emitters are more useful for shaping the electron beam and consequent focal spot on the anode. However, planar emitters, due to their structure, are difficult to mount within a device due to the extremely high temperatures needed for thermionic emission. Such temperatures often exceed the capability of materials used in the planar emitter, and also lead to relatively large thermal expansion of the emitter assembly. Such thermal expansion often results in relative high variability in the resulting focal spots, which decreases the optical precision and ratability of the x-ray tube.

SUMMARY

In one example embodiment, an emitter assembly utilizing a planar emitter configuration is disclosed. The emitter assembly in this example utilizes a structure to "clamp" the emitter between heat resistant elements. In disclosed embodiments, the clamping can be accomplished near the edges of the emitter, where the temperature excursions are not so extreme. For example, in one disclosed approach, the compressive force is applied to ceramic elements which sandwich the emitter between them. The compressive force is applied to the ceramic (or similar material) clamping materials during assembly by a metal clamp, or other ceramic members, tensioned to maintain the clamping force through the expected temperature range of the device during operation.

The heat resistant elements might be configured as separate structures in the form, for example, of an elongate rod. Alternatively, the heat resistant elements might be provided by way of a coating applied to surfaces of the emitter itself. Different sizes and/or shapes might be utilized to achieve different thermal isolation properties, depending on the needs of a particular application.

In another embodiment, methods of assembling an electron emitter assembly are disclosed. In one disclosed example, a method of assembly includes providing a support mount within an evacuated enclosure of an x-ray tube. An electron emitter is secured to the support mount in a manner such that the emitter is thermally isolated from the support mount. For example, in one embodiment, the emitter is secured to the support mount by disposing at least two heat resistant elements along an outer surface of the electron emitter, and then applying a force to the heat resistant elements so as to retain the emitter to the support mount. This approach insures that there is substantial thermal isolation between the support mount and the emitter during operation of the x-ray tube.

Disclosed embodiments provide a number of advantages. For example, use of a low thermal conduction material to clamp the emitter along its edges reduces waste heat that is conducted to the surrounding support structure. Moreover, compressive clamping forces applied to such high temperature materials (such as ceramic or PBN) takes advantage of this type of material's compressive strength at high temperatures. In addition, the ability to apply a clamping force at a point that is somewhat thermally isolated from the heated portion of the emitter (e.g. along its edges) means that the heat resistant elements are exposed to lower temperatures, thereby allowing a wider range of materials to be used—including less exotic and/or less expensive materials, thereby allowing for a lower cost support structure. Further, the disclosed clamping structure maintains a uniform operating temperature along the edges of the emitter, thereby simplifying the thermal design of the emitter itself and allowing accurate and repeatable performance in use. This results in low variability in the resulting focal spots—a condition that allows precision design of the x-ray optics and ratability of the x-ray tube.

This Summary is provided to introduce a selection of concepts in a simplified form that are further described below in the detailed description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Example embodiments of the present invention are directed to a thermionic electron emitter designed to emit a beam of electrons for generating x-rays. The electron emitter is fabricated from a refractive metal that emits or "boils off" electrons when heated by an electrical current. Electron emission is dependent on the amount of current flowing through the electron emitter and on the temperature of the electron emitter. During the tube operation, the electron emitter expands. Various configurations of heat resistant elements, in conjunction with clamps, are provided to secure the electron emitter in place as the electron emitter expands thermally during tube operation.

I. X-Ray Devices

Figure 1:
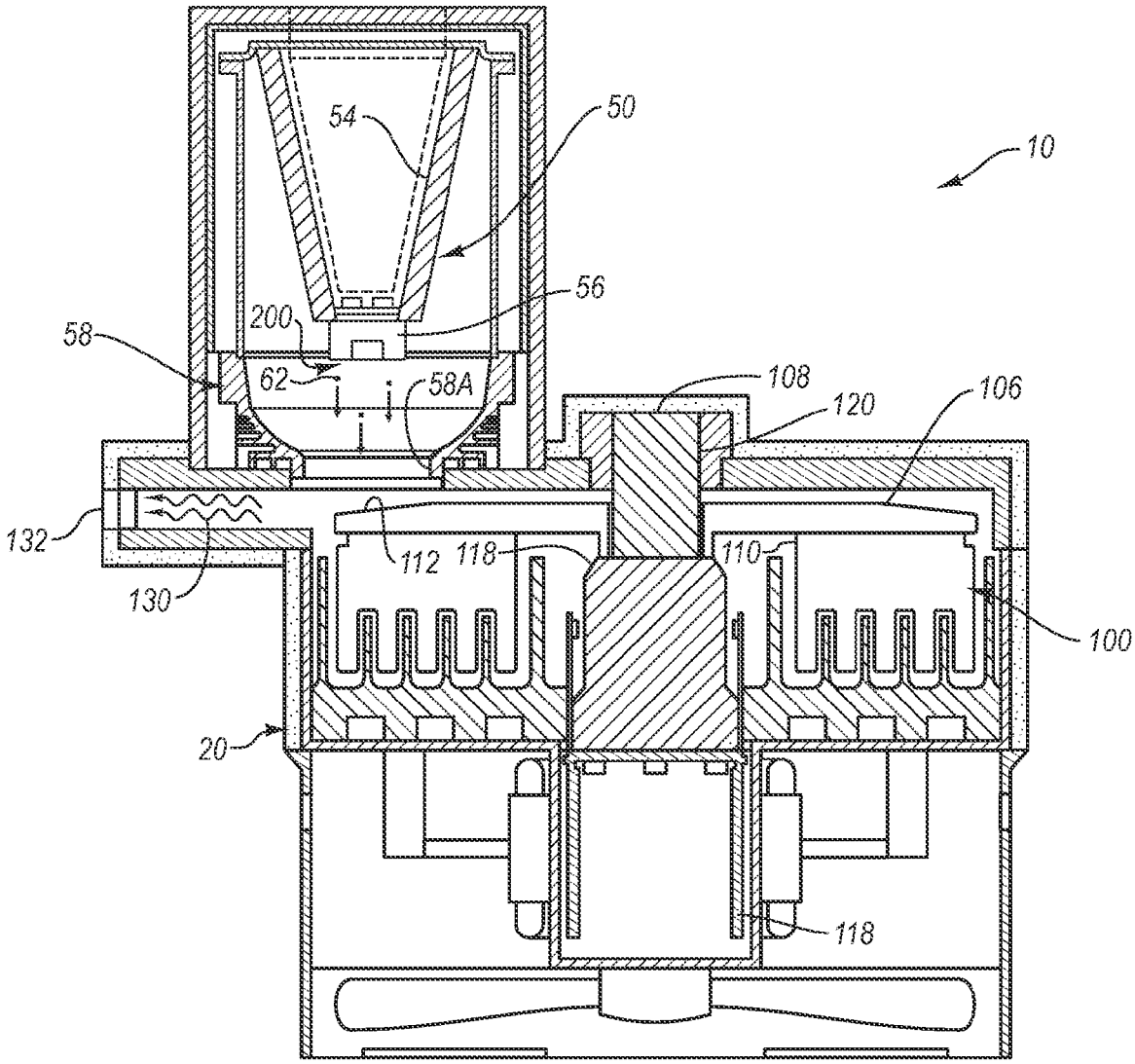
FIG. 1 illustrates one example embodiment of an x-ray tube.

Reference is first made to FIG. 1, which depicts one possible environment wherein embodiments of the present invention can be practiced. Particularly, FIG. 1 shows an x-ray tube, designated generally at 10, which serves as one example of an x-ray generating device. The x-ray tube 10 generally includes an evacuated enclosure 20 that houses a cathode assembly 50 and an anode assembly 100. The evacuated enclosure 20 defines and provides the necessary envelope for housing the cathode and anode assemblies 50, 100 and other critical components of the tube 10 while providing the shielding and cooling necessary for proper x-ray tube operation. The evacuated enclosure 20 further includes shielding so as to prevent unintended x-ray emission from the tube 10 during operation. Note that, in other embodiments, the x-ray shielding is not included with the evacuated enclosure, but rather might be joined to a separate outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. While other configurations could be used, in the illustrated example the cathode assembly 50 includes a support structure 54 that supports a cathode head 56, which in turn supports an electron emitter assembly, designated generally at 200 and discussed in further detail below. In the example of FIG. 1, an aperture shield 58 defines an aperture 58A that is positioned between the electron emitter assembly 200 and the anode 106 to allow electrons 62 emitted from the electron emitter assembly to pass. The aperture shield 58 in some embodiments can be cooled by a cooling fluid as part of a tube cooling system (not shown) in order to remove heat that is created in the aperture shield as a result of errant electrons impacting the aperture shield surface. FIG. 1 is representative of one example of an environment in which claimed embodiments of an emitter assembly might be utilized. However, it will be appreciated that there are many other x-ray tube configurations and environments for which embodiments of the emitter assembly would find use and application.

As mentioned, the cathode head 56 includes an electron emitter assembly 200 as an electron source for the production of the electrons 62 during tube operation. As such, the electron emitter assembly 200 is appropriately connected to an electrical power source (not shown) to enable the production by the assembly of the high-energy electrons, generally designated at 62.

The illustrated anode assembly 100 includes an anode 106, and an anode support assembly 108. The anode 106 comprises a substrate 110, here composed of graphite, and a target surface 112 disposed thereon. The target surface 112, in one example embodiment, comprises tungsten or tungsten rhenium, although it will be appreciated that depending on the application, other "high" Z materials/alloys might be used. A predetermined portion of the target surface 112 is positioned such that the stream of electrons 62 emitted by the electron emitter 200 and passed through the shield aperture 58A impinge on the target surface so as to produce the x-rays 130 for emission from the evacuated enclosure 20 via an x-ray transmissive window 132.

The kinetic energy resulting from the impingement of electrons on the target surface also yields large quantities of heat. Excess heat can be removed by way of a number of approaches and techniques. For example, in the disclosed embodiment a coolant is circulated through designated areas of the anode assembly 100 and/or other regions of the tube. Again, the structure and configuration of the anode assembly can vary from what is described herein while still residing within the claims of the present invention.

In the illustrated example, the anode 106 is supported by the anode support assembly 108, which generally comprises a bearing assembly 118, and a support shaft 120. The support shaft 120 is fixedly attached to a portion of the evacuated enclosure 20 such that the anode 106 is rotatably disposed about the support shaft via the bearing assembly 118, thereby enabling the anode to rotate with respect to the support shaft. Again, it should be appreciated that embodiments of the present invention can be practiced with anode assemblies having configurations that differ from that described herein. Moreover, in still other tube implementations and applications, the anode may be stationary.

Figure 1A:
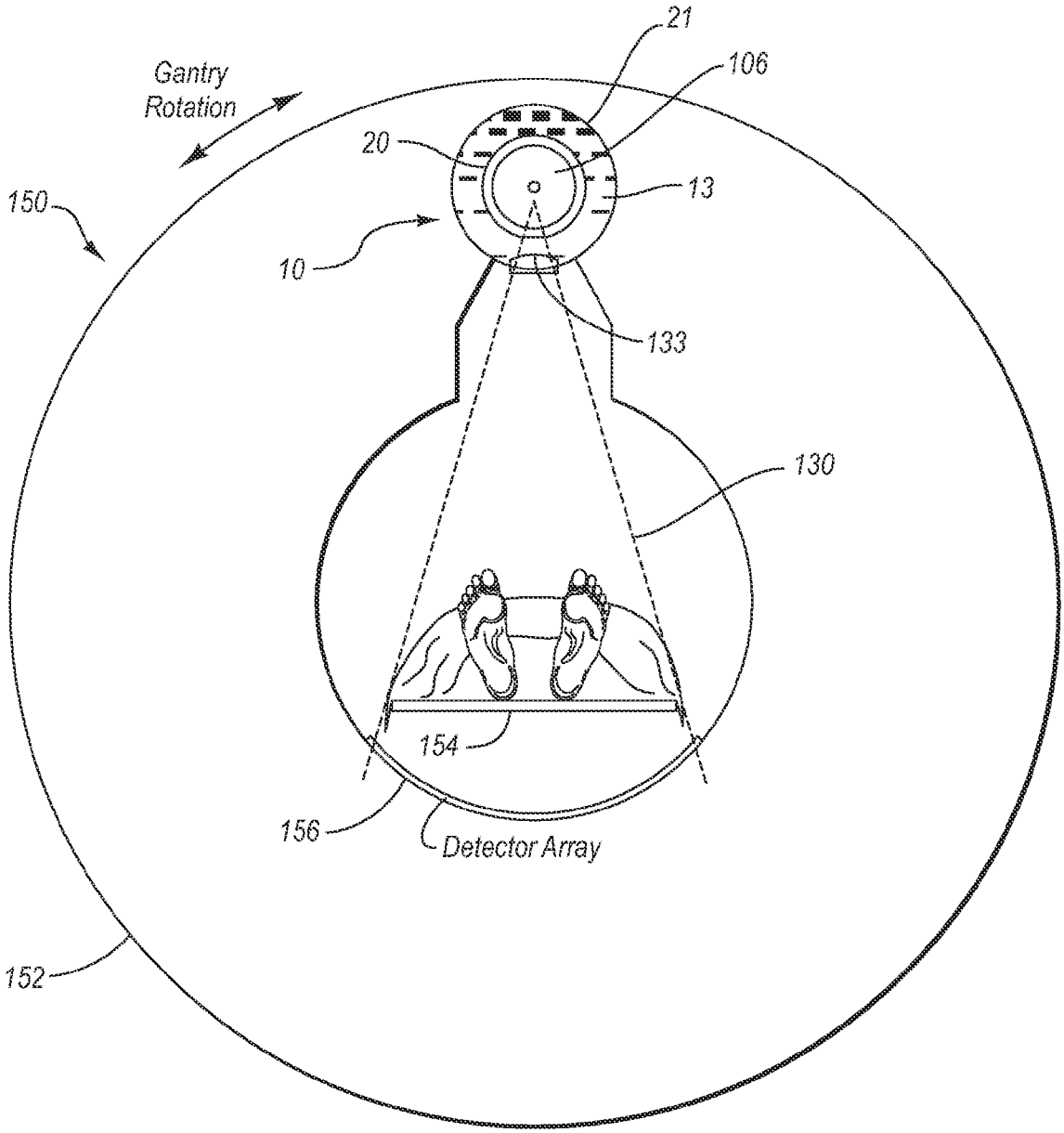
FIG. 1A illustrates one example of an x-ray imaging device utilizing the x-ray tube of FIG. 1.

While the example x-ray tube 10 of FIG. 1 might be utilized in any one of a number of different environments and applications, FIG. 1A illustrates one example of an imaging device, designated generally at 150 within which tube 10 might be used. In this particular example, the imaging device is a CT scanner, which generally comprises a rotatable gantry 152 and a patient platform 154. An x-ray tube, such as the x-ray tube 10 depicted in FIG. 1, is mounted to the gantry 152 of the scanner 150. In operation, the gantry 152 rotates about a patient lying on the platform 154. The x-ray tube 10 is selectively energized during this rotation, thereby producing a beam of x-rays that emanate from the tube as the x-ray beam path 130. After passing through the patient, the unattenuated x-rays are received by a detector array 156. The x-ray information received by the detector array 156 can be manipulated into images of internal portions of the patient's body to be used for medical evaluation and diagnostics.

The x-ray tube 10 of FIG. 1A is depicted in cross section and shows an outer housing 21, the evacuated enclosure 20, and the anode 106 disposed therein, at which point the x-rays in beam 130 are produced. The x-ray tube 10 further shows an outer housing window 133 disposed in the outer housing 21 and adjacent a cooling fluid depicted at 13.

II. Electron Emitter Assembly Embodiments

Figure 2A:
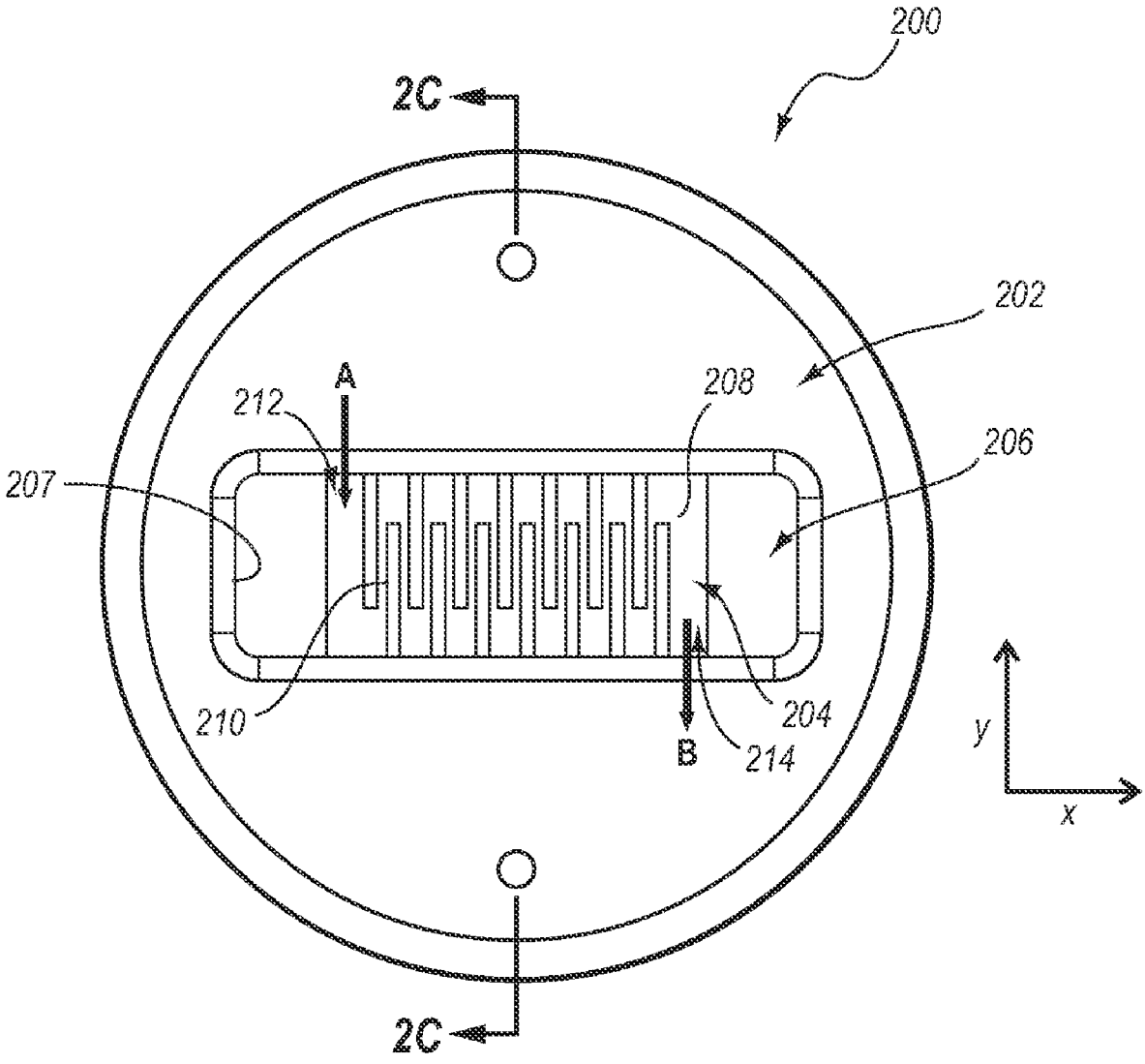
FIG. 2A illustrates one embodiment of an electron emitter assembly.

Attention is now directed to FIGS. 2A-2D, which together illustrate further details concerning one example embodiment of an electron emitter assembly 200. As shown in FIG. 2A, in one embodiment the electron emitter assembly 200 includes a clamp structure, designated generally at 202, an electron emitter, designated generally at 204, a plurality of heat resistant elements (shown in further detail in FIGS. 2C and 2D), and a supporting mount, designated generally at 206. In the configuration shown, the electron emitter 204 is disposed on top of the supporting mount 206, and the clamp 202 is positioned with respect to the supporting mount 206 so as to secure the electron emitter 204 in place by applying a compressive force, as will be described in further detail below. The exemplary clamp structure 202 further includes an emission window 207 so as to permit emitted electrons to discharge from the electron emitter 204 towards the anode. The clamp 202 can be affixed to the supporting mount 206 via screws, bolts, rivets, or other suitable attachment means.

Figure 2B:
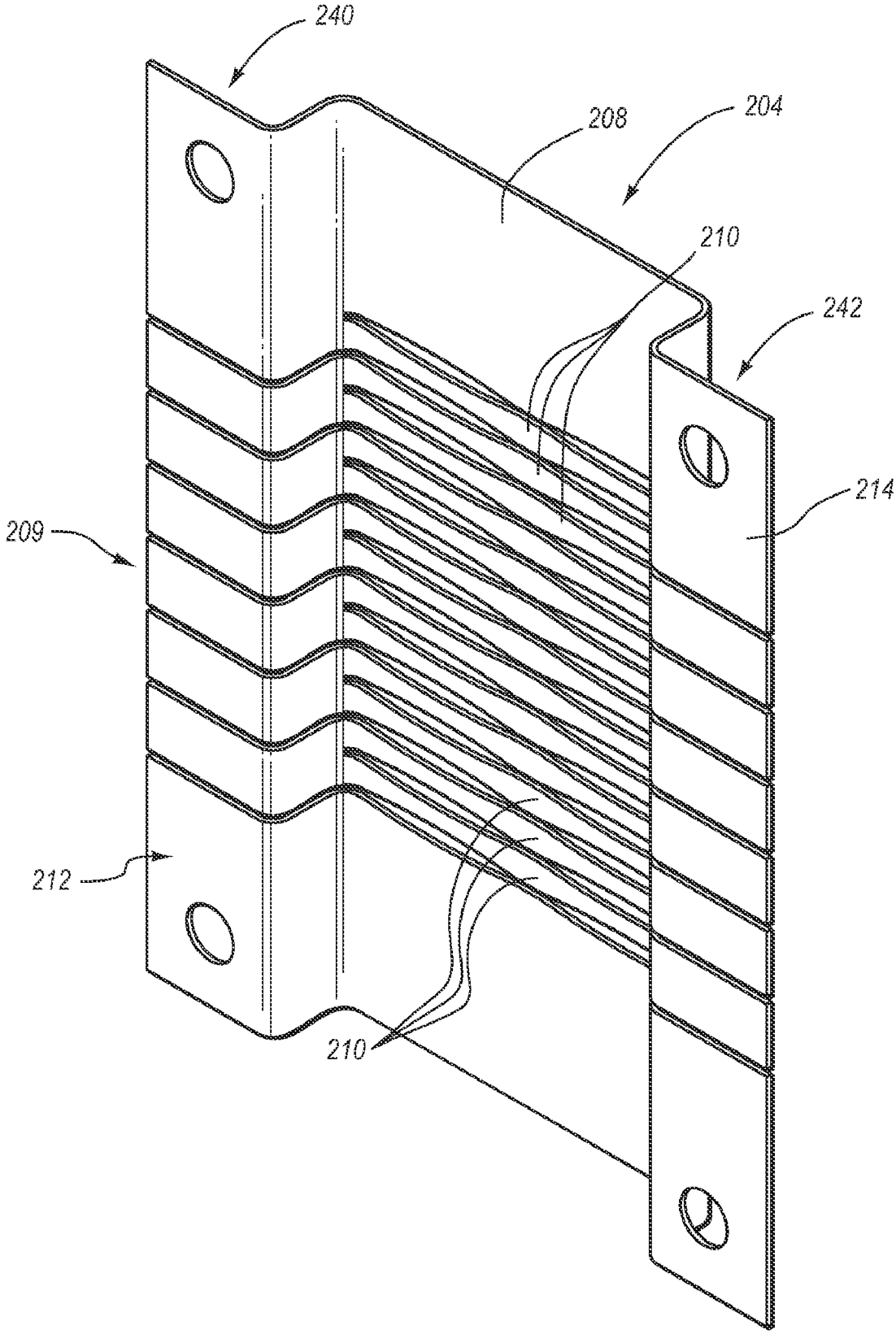
FIG. 2B illustrates one embodiment of a perspective view of an electron emitter.

Shown as an example in FIG. 2A, and in further detail in the perspective view of FIG. 2B, the electron emitter 204 is configured as a planar emitter, although other emitter structures could be utilized. Here, electron emitter 204 comprises a refractory metal foil 208 configured to include a plurality of rung segments 210. When heated via an electrical current during tube operation, the plurality of rung segments 210 are configured to emit electrons (denoted at 62 in FIG. 1).

In one example embodiment the dimensions of the electron emitter 204 shown in FIG. 2B are approximately 0.5 inches (length)×0.5 inches (width)×0.003 inches (thickness), but different lengths, widths, thickness, and shapes can also be used depending on the needs of a particular application and related design constraints. As is shown in the depicted embodiment of FIG. 2B, the electron emitter 204 consists of first end 212, second end 214, and a middle portion 209, which is comprised of a plurality of rung segments 210. In the illustrated configuration, the ends and middle portion together form a continuous electrically conductive element. While other shapes might be used, in the illustrated embodiment the electron emitter 204 is in the form of a box-shaped depression or protrusion. Other shapes may include but are not limited to, a surface that is substantially flat, parabolic, or curved, or a surface that is angled in the center portion (triangle-shaped depression), or that is formed with a trapezoid-shaped depression or protrusion.

The electron emitter assembly 200 further includes at least two electrical connection points. The electrical connection points are in electrical communication with a power source via leads 226 (shown in FIG. 2C) so as to enable operation of the electron emitter assembly 200 by supplying a suitable operating voltage and current thereto. In the depicted embodiment, the ends 212, 214 and the plurality of rung segments 210 are electrically connected in series, though it is appreciated that the rung segments can be connected in parallel in other embodiments. When the refractory metal foil 208 is electrically energized, the electrical current may flow from the first end 212, through the plurality of rung segments 210, to the second end 214, as is denoted at lines A and B in FIG. 2A. So configured, the plurality of rung segments 210 operate to simultaneously produce electrons during tube operation. During such operation, in the illustrated embodiment it is the central portion of each rung segment that produces the substantial portion of electrons via thermionic emission. It is appreciated that in other embodiments, more or fewer end and rung segments can be included in the electron emitter assembly 200, and that the rung segments may be sized and/or shaped differently to achieve different electron emission characteristics. In other embodiments, different directions of the current flow may also be contemplated.

In one embodiment, the electron emitter 204 may be made of thorium doped tungsten, which may further include a carbon dopant (i.e., the thoriated tungsten is carburized). Carburization of a thoriated tungsten electron emitter assembly is typically achieved by subjecting the completed electron emitter assembly to a heat treatment in a hydrocarbon atmosphere consisting of a hydrogen carrier gas and benzene, naphthalene acetylene, or xylene. When the electron emitter assembly is heated in the presence of the hydrocarbon to a temperature on the order of 2000° C., the hydrocarbon is decomposed at the hot filament surface to form tungsten carbide that diffuses into the tungsten. Inclusion of the carbon dopant significantly increases the useful lifespan of an electron emitter assembly fabricated from thoriated tungsten by reducing the rate of thorium evaporation from the thoriated tungsten. Additional details regarding altering the work function of filaments can be found in U.S. application Ser. No. 11/350,975, entitled "Improved Cathode Structures for X-Ray Tubes," filed Feb. 8, 2006, which is incorporated herein by reference in its entirety (referred to herein as the '975 application). Note that in other embodiments, the electron emitter may be made of other materials that include low work function materials that are suitable for thermionic electron emission when heated. Such material may also exhibit the property of having low thermal mass.

While others may be used, additional configurations of suitable electron emitter structures are also disclosed in: U.S. patent application Ser. No. 11/942,656 entitled "FILAMENT ASSEMBLY HAVING REDUCED ELECTRON BEAM TIME CONSTANT" and filed Nov. 19, 2007 (referred to herein as the '656 application); and U.S. patent application Ser. No. 12/238,200 entitled "THERMIONIC EMITTER DESIGNED TO PROVIDE UNIFORM LOADING AND THERMAL COMPENSATION" filed Sep. 25, 2008; the contents of each of which are incorporated herein by reference in their entirety.

Figure 2C:
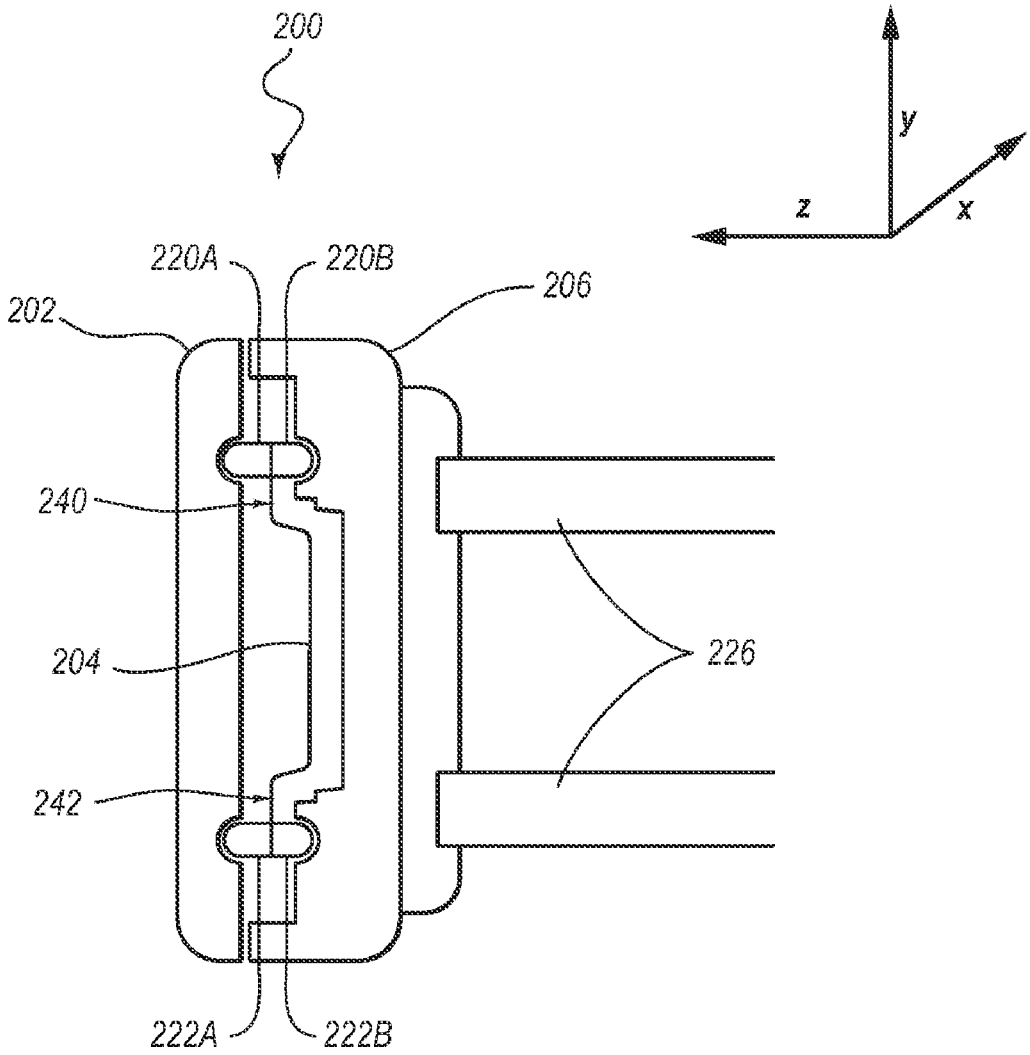
FIG. 2C illustrates a cross-sectional view of the electron emitter assembly of FIG. 2A.

FIG. 2C depicts a cross-sectional view of the electron emission assembly 200 of FIG. 2A taken along lines 2C-2C. As is shown, the clamp 202 is disposed over the supporting mount 206 so as to retain the emitter 204 in place, by applying a compressive force to a plurality of heat resistant elements (i.e., heat resistant elements 220A, 220B, 222A, and 222B). In this regard, in the illustrated configuration one manner of securing the emitter 204 between a plurality of heat resistant elements 220A, 220B, 222A, and 222B is shown. It will be appreciated that the clamp 202 is but one example of a means for imposing a compressive force on the heat resistant elements so as to retain the electron emitter within the electron emitter assembly. Other structures might be used to perform the same function.

In the illustrated example, a first edge 240 of the emitter 204 is disposed between the heat resistant elements 220A and 220B, and a second edge 242 of the emitter 204 is disposed between the heat resistant elements 222A and 222B. Here, the heat resistant elements 220A, 220B, 222A, and 222B are secured in place via the compressive pressure applied by affixing the clamp 202 onto the supporting mount 206, thereby holding the emitter 204 in place via the heat resistant elements. The metal clamp 202 may be affixed onto the support mount 206 via screws, bolts, rivets, or other suitable attachment means.

In the example embodiment, the clamping is accomplished along the longitudinal edges of the emitter 204 (edges 240 and 242), and positioned where temperature excursions are not as extreme during tube operation. Moreover, since the clamping is provided via compressive force imposed on the heat resistant elements and tensioned so as to maintain a clamping force through the expected temperature excursions of the device during operation, the position of the emitter 204 is not affected by thermal expansion, and thus the focus and integrity of the electron beam (and the resulting focal spot) is maintained to a high precision. This ultimately results in higher image quality.

Figure 2D:
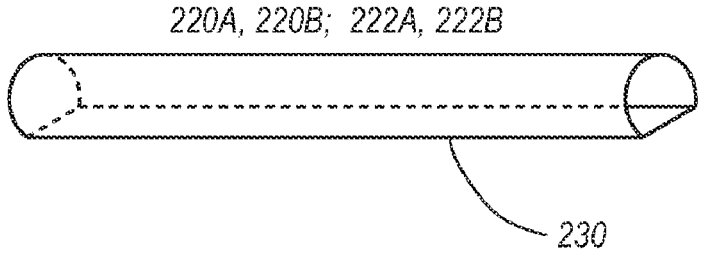
FIG. 2D illustrates one example of a heat resistant element.

One example of the heat resistant elements 220A, 220B, 222A, and 222B are shown in the perspective view of FIG. 2D. Here, the heat resistant element is configured as an elongate member having a generally semicircular cross-section, a width sufficient to provide adequate heat isolation, and a length sufficient to secure the electron emitter between the clamp 202 and the supporting mount 206. So configured, the surface of the heat resistant element in contact with the electron emitter 204 is generally flat (i.e., to correspond to the "clamped" portion of the flat surface of edge 240, 242). In one embodiment, the dimensions of the heat resistant elements are such that there is some space between the clamp 202 and the support mount 206, such that the clamping force bears on the element 220A, 220B and emitter 204 stack. In such an embodiment, the clamp 202 might bend slightly as, for example, screws or other fastening means pull it down tightly to the support mount 206. In alternative embodiments, the clamp 202 might contact support mount 206 first, and then bend on the stack. Also, while one specific shape is shown, it will be appreciated that the heat resistant element may be configured with different shapes and sizes depending, for example, on the needs of a particular application. Alternative cross-sectional shapes may include, but are not limited to, rectangle, circle, oval, trapezoid, parallelogram, triangle, or any other suitable shape.

In an alternative embodiment, the heat resistant elements may be formed by applying a coating to the surface of the electron emitter along the respective edges. In one embodiment, this coating is applied electrophoretically, and the clamp is then secured to apply the compressive force directly to the respective coatings, thereby securing the emitter in place. Such an approach might be used, for example, for applications requiring a fast cooling emitter. With this approach, the clamp 202 material and the support structure 206 material might be chosen so as to have very high thermal conduction properties. Such materials might include, for example, molybdenum, TZM or nickel. Further details for this embodiment can be found in the '656 application, incorporated herein by reference.

In alternative embodiments, the heat resistant elements may also be configured so as to not be positioned directly across from the opposing heat resistant element, but in a manner so as to be in offset longitudinal positions with respect to each other. This approach—offsetting the opposing heat resistant elements from one another—utilizes the emitter material as a spring to further absorb expansion movement. One such approach is shown and described further in connection with FIGS. 4 and 5 below.

The material chosen to comprise the heat resistant element is one that provides adequate thermal isolation. However, other characteristics might also be sought, including high temperature resistance (for example, greater than about 1000° C.), good compressive rate, or any combination of thereof. The heat resistance element may be made of materials that include, but are not limited to, fully stabilized zirconia, aluminum nitrate, malite, pyrolytic boron nitride (PBN), or other suitable materials, such as other ceramics.

While a number of materials might be used for the clamp 202 and the supporting mount 206, suitable characteristics of the material might include high temperature strength. In one example, both the clamp and the mount are comprised of a metal, such as molybdenum or TZM. Other suitable materials might include, but are not limited to: nickel, stainless steel.

As will be appreciated from the foregoing, the disclosed emitter assembly 200 provides a number of advantages. Although other emitter configurations might be used, the disclosed embodiment is suitable for use with a planar emitter, which provides optimal electron beam emission. In addition, the disclosed structure allows for the use of the planar emitter in extremely high operating temperatures, and yet minimizes negative effects that would otherwise result from thermal expansion. In particular, the clamping configuration of the emitter assembly, including the use of the heat resistant elements 220 and 222, largely negates the effect of thermal expansion of the emitter and surrounding structures, and thereby insures a stable emitter assembly throughout the operating temperatures, and better overall electron stream resolution and resulting focal spot. Other advantages will be recognized through practice of the invention, as it is defined by the accompanying claims.

Figure 3:
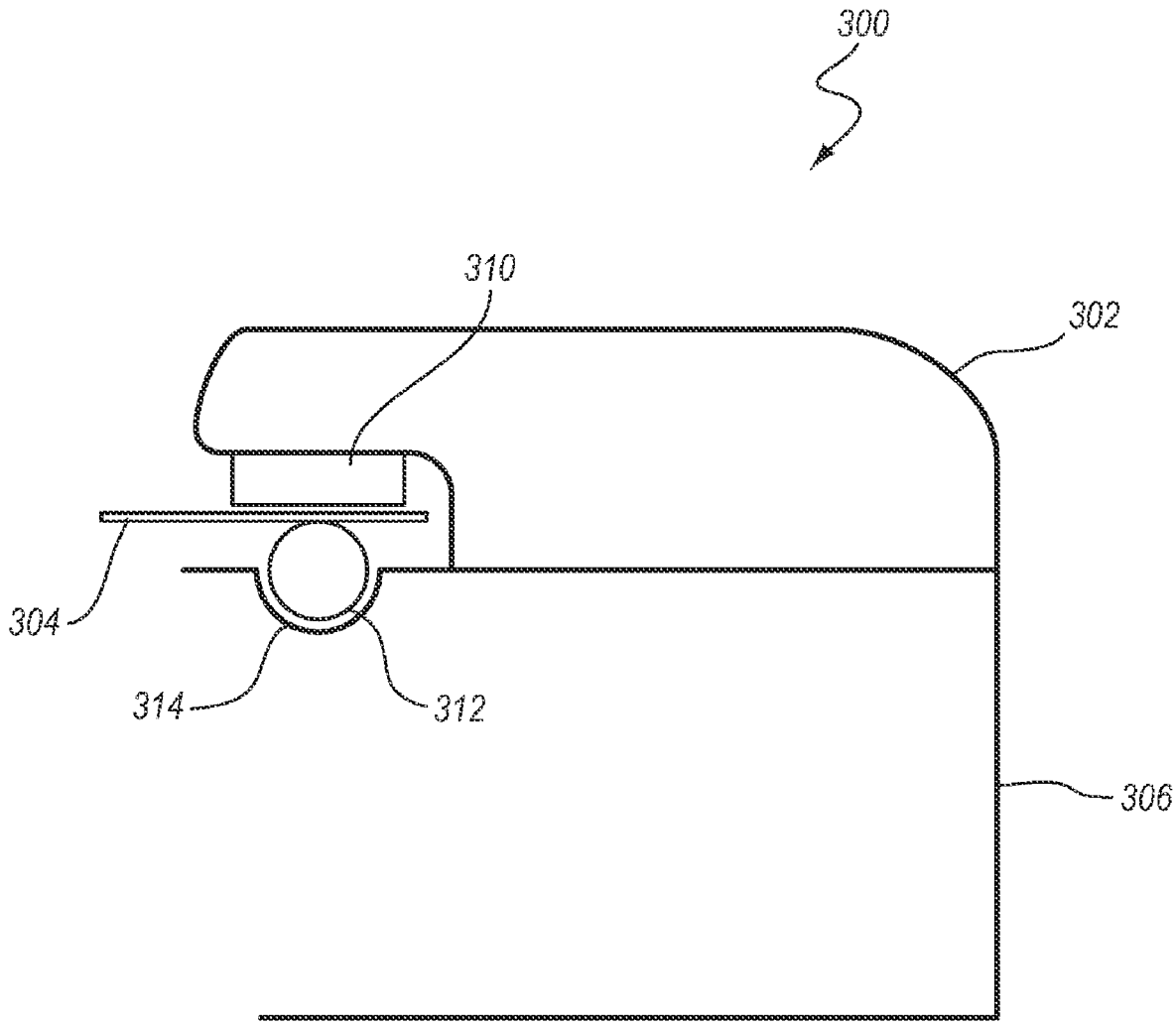
FIG. 3 illustrates another example embodiment of an electron emitter assembly.

It will be appreciated that while one particular example embodiment has been described, other configurations and embodiments could be utilized for the emitter assembly. For example, FIG. 3 shows a partial cross-sectional view of one alternative embodiment of an electron emission assembly, designated generally at 300. In this particular embodiment, the electron emission assembly 300 includes a clamp 302, a support mount 306, an electron emitter 304, a first heat resistant element 310, and a second heat resistant element 312. As is shown in this example, the first heat resistant element 310 may be configured as an elongate member with sufficient length to secure the electron emitter 304 by virtue of the compressive force applied via clamp 302. In this configuration, the first resistant element 310 is configured to having a flat surface (i.e., a rectangular block, plate, or sheet of the heat resistant material) that is in physical contact with a corresponding surface of the electron emitter 304. The second heat resistant element 312 may be an elongated member having a generally circular cross-section and approximately the same length as the first heat resistant element. The second resistant element 312 is partially disposed within a recess formed within the surface of the support mount 306, such as slot 314. The slot 314 may have different shapes to accommodate or otherwise retain the resistant element, and such shapes might include semi-circular, oval, rectangular, square, and triangular. The slot 314 may or may not conform to the shape of the second heat resistant element 312. As was the case with the embodiment of FIG. 2, the edges of electron emitter 304 are thus retained by virtue of the clamping force applied by the pair of heat resistant elements 310 and 312 and the clamp 302. Note that other heat resistant element shapes might be used, so as to provide a greater, or lesser, surface area contact with adjacent surfaces, and thereby influence/control the rate and/or direction of heat conduction within the emitter assembly.

Figure 4:
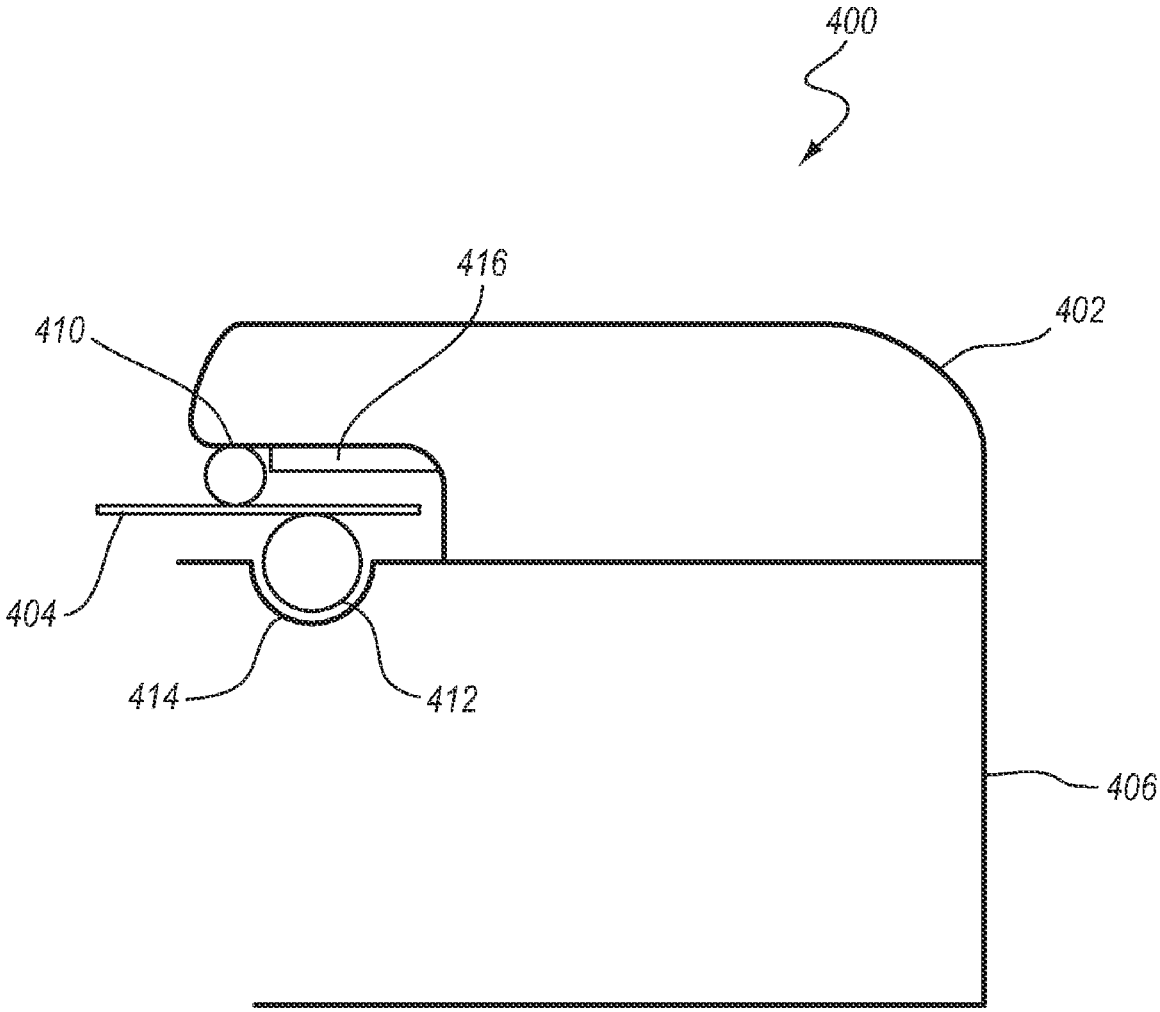
FIG. 4 illustrates another embodiment of an electron emitter assembly.

FIG. 4 shows a partial cross-sectional view of yet another embodiment of an electron emission assembly, denoted generally here at 400. In this particular embodiment, the electron emission assembly 400 includes a clamp 402, a support mount 406, an electron emitter 404, a first heat resistant element 410, a second heat resistant element 412, and a third heat resistant element 416. The first heat resistant element 410 is configured as an elongate member having a generally circular cross-section and of sufficient length to secure the electron emitter 404 along its edge. Note that in illustrated embodiments, the lengths of the heat resistant elements are sufficient to contact the emitter at least along all of the heated rungs of the emitter. This provides a uniform heat sinking and a uniform thermal profile at the edge of all of the heated rungs. The second heat resistant element 412 is an elongate member, also configured here with a generally circular cross-section, and having approximately the same length as the first heat resistant element 410. Heat resistant element 412 is disposed within a recess, such as slot 414, which is formed on a top surface of the support mount 406. The slot 414 may have different cross sectional shapes that serve to retain the element 412, and may be formed as a semi-circular, oval, rectangular, square, or triangular shape, among others. While the example embodiment of FIG. 4 illustrates a slot 414 having a shape that substantially conforms to the shape of the element 412, it will be appreciated that other embodiments might utilize a slot having a shape that does not conform to the shape of the second heat resistance element 412. The shape selected might be dictated by the type of thermal transfer required, among other considerations.

As is further shown in the embodiment of FIG. 4, the third heat resistant element 416 is also an elongate member with sufficient length to secure the electron emitter 404 along its edges, and in this example has a non-circular cross section. In the embodiment of FIG. 4, the third heat resistant element 416 is provided with a substantially rectangular cross-sectional shape, and may be fabricated as a rectangular block, a plate, or a thin layer of the chosen material. In the illustrated example, the third heat resistant element 416 is employed to provide a thermal barrier or separator between the electron emitter 404 and the clamp 402.

In the embodiment of FIG. 4, each longitudinal edge of the electron emitter 404 is secured between the first and second heat resistant elements 410 and 412 by virtue of the clamping force imposed by the clamp 402. As is shown, the first and second heat resistant elements are offset from one another (i.e., the first and second heat resistance element 410 and 412 are not directly across from each other). Configured as such, the emitter 404 material acts as a spring and thus is further capable of absorbing movement caused by thermal expansion.

Figure 5:
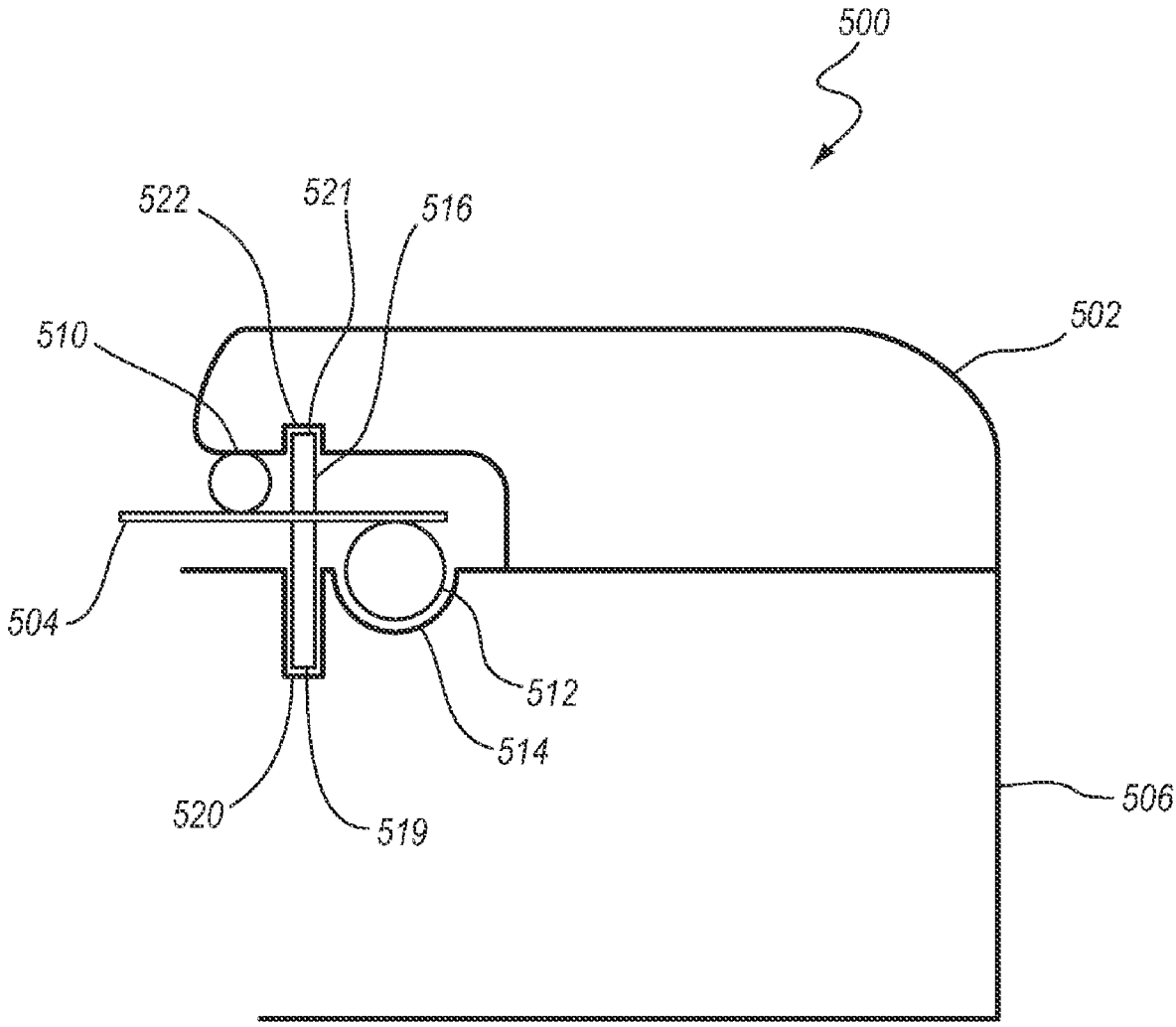
FIG. 5 illustrates yet another embodiment of an electron emitter assembly.

FIG. 5 shows a partial cross-sectional view of yet another embodiment of an electron emission assembly, designated generally here at 500. In this embodiment, the electron emission assembly 500 includes a clamp 502, a support mount 506, an electron emitter 504, a first heat resistant element 510, a second heat resistant element 512, and a third heat resistant element 516. The first heat resistant element 510 is configured an elongated member with sufficient length to secure the electron emitter 504 along its edge. In this embodiment, element 510 has a generally circular cross-section. The second heat resistance element 512 is an elongate member with approximately the same length as the first heat resistance element 510, and also having a generally circular cross-section. In this embodiment, element 512 is disposed within a recess, such as slot 514, that is formed in a top surface of the support mount 506. As with previous embodiments, the slot 514 may be formed with different shapes that may or may not conform to the shape of the second heat resistance element 512 that is being supported/retained.

In the embodiment of FIG. 5, the third heat resistant element 516 is provided as a "pin" that is configured to protrude through one a hole (not shown) formed through the electron emitter 504 along its edge. In addition, each edge of the element 516 (denoted at 519 and 521) is retained within corresponding recesses formed within the top surface of support 506, shown as slot 520, and formed within the bottom surface of clamp 502, shown as slot 522. This prevents lateral movement of the element 516, and further serves to retain the emitter 504 in place—even in the presence of thermal expansive movement. Note that the size and shape of the element 516 might vary—again depending on the needs of a particular application such as thermal isolation requirements. In this configuration, the electron emitter 504 is secured between the first and second heat resistant elements 510 and 512 by way of a clamping force, and is further secured by the third heat resistant element 516. The first and second heat resistant elements 510 and 512 may be disposed adjacent to the third heat resistant element 516. The clamp 502 may be employed to secure the electron emitter 504 and the heat resistant elements 510, 512, and 516 onto the support mount 506.

In summary, embodiments of the present invention provide a number of advantages over the prior art. Disclosed embodiments provide a unique approach for mounting an electron emitter—including planar emitters—within an emitter assembly such that positioning (and hence electron emission accuracy) is not adversely affected by extreme operating temperatures. For example, use of a low thermal conduction material to clamp the emitter along its edges reduces waste heat that is conducted to the support structure. Moreover, compressive clamping forces applied to such high temperature materials (such as ceramic or PBN) takes advantage of this type of material's compressive strength at high temperatures. In addition, the ability to apply a clamping force at a point that is somewhat thermally isolated from the heated portion of the emitter (e.g. along its edges) means that the heat resistant elements are exposed to lower temperatures, thereby allowing a wider range of materials to be used—including less exotic and/or less expensive materials, thereby allowing for a lower cost support structure. Further, the disclosed clamping structure maintains a uniform operating temperature along the edges of the emitter, thereby simplifying the thermal design of the emitter itself and allowing accurate and repeatable performance in use. This results in low variability in the resulting focal spots—a condition that allows precision design of the x-ray optics and ratability of the x-ray tube.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube, comprising:
- a vacuum enclosure;
- an anode positioned within the vacuum enclosure and including a target surface; and
- a cathode spaced apart from the target surface, the cathode including an electron emitter assembly comprising:
  - an electron emitter;
  - a support mount;
  - a pair of heat resistant elements disposed along an edge of the electron emitter, the pair of heat resistant elements comprised of a material having a low thermal conductivity relative to the support mount; and
  - means for imposing a compressive force on the pair of heat resistant elements so as to retain the electron emitter within the electron emitter assembly.

2. The x-ray tube of claim 1, wherein the electron emitter is configured as a planar emitter having a plurality of rung segments.

3. The x-ray tube of claim 2, wherein the plurality of rung segments are electrically connected in series or in parallel.

4. The x-ray tube of claim 1, wherein the electron emitter comprises one or more of the following: tungsten alloy, tantalum, tantalum alloy, hafnium, hafnium carbide.

5. The x-ray tube of claim 1, wherein the heat resistant material comprises zirconium, aluminum nitrate, malite, or pyrolytic boron nitride.

6. The x-ray tube of claim 1, wherein the heat resistant element has a cross-sectional shape selected from one of the following: circular, square, rectangular, trapezoidal, parallelogram, or triangle.

7. The x-ray tube of claim 1, wherein a first edge of the electron emitter is disposed between a first pair of heat resistant elements and a second edge of the electron emitter is disposed between a second pair of heat resistant elements.

8. The x-ray tube of claim 7, wherein the heat resistant elements of each pair are substantially directly opposite of each other.

9. The x-ray tube of claim 7, wherein the heat resistant elements of each pair are opposite of each other in an offset relationship.

10. The x-ray tube of claim 7, further comprising a third heat resistant element associated with each pair of heat resistant elements.

11. The x-ray tube of claim 10, wherein the third heat resistance element extends through a hole formed in the electron emitter.

12. The x-ray tube of claim 1, wherein at least one heat resistant element is at least partially disposed within a recess formed within a surface of the support mount.

13. The x-ray tube of claim 1, wherein the at least one heat resistant element comprises a coating formed along an edge of the outer surface of the electron emitter.

14. The x-ray tube of claim 1, wherein the coating is an electrophoretic coating.

15. The x-ray tube of claim 1, wherein the means for imposing a compressive force comprises a metal clamp having an electron emission window and that is affixed to the support mount so as to enclose the electron emitter and thereby retain the emitter via the heat resistant elements.

16. An x-ray imaging device, comprising:
- an x-ray detector; and
- an x-ray source, comprising:
  - a vacuum enclosure;
  - an anode positioned within the vacuum enclosure and including a target surface; and
  - a cathode spaced apart from the target surface, the cathode including an electron emitter assembly, the electron emitter assembly comprising:
  - an electron emitter;
  - a support mount;
  - a heat resistant element disposed along an outer surface of the electron emitter; and
  - at least one clamp affixed to the support mount so as to apply a compressive force to the heat resistant element and thereby retain the electron emitter within the electron emitter assembly.

17. The x-ray imaging device of claim 16, wherein the electron emitter is a planar emitter structure comprising a refractory metal foil.

18. The x-ray imaging device of claim 16, wherein the heat resistant element comprises a material having a thermal conductivity that is less than that of the clamp and the support structure.

19. The x-ray imaging device of claim 16, wherein the heat resistant element comprises a ceramic material.

20. The x-ray imaging device of claim 16, wherein the heat resistant element comprises a material selected from zirconium, aluminum nitrate, malite, pyrolytic boron nitride or combinations thereof.

21. The x-ray imaging device of claim 16, wherein the heat resistant element comprises an elongate member having substantially the same length as the corresponding edge of the electron emitter.

22. The x-ray imaging device of claim 16, wherein the heat resistant element has a cross-sectional shape selected from one of the following: circular, square, rectangular, trapezoidal, parallelogram, or triangular.

23. The x-ray imaging device of claim 16, wherein a first edge of the electron emitter is disposed between a first pair of heat resistant elements and a second edge of the electron emitter is disposed between a second pair of heat resistant elements.

24. The x-ray imaging device of claim 23, wherein the heat resistant elements of each pair are positioned so as to be substantially directly opposite of each other.

25. The x-ray imaging device of claim 23, wherein the heat resistant elements of each pair are positioned so as to be opposite of each other in an offset relationship.

26. The x-ray imaging device of claim 23, further comprising a third heat resistant element associated with each pair of heat resistant elements.

27. The x-ray imaging device of claim 26, wherein the third heat resistant element is positioned so as to extend through a hole formed along an edge of the electron emitter.

28. The x-ray imaging device of claim 16, wherein the clamp is affixed onto the support mount by screws, rivets, or brazing.

29. The x-ray imaging device of claim 16, wherein the clamp is affixed onto the support mount by a metallurgic bond.

30. A method of assembling an electron emitter, the method comprising the steps of:

providing a support mount within an evacuated enclosure of an x-ray tube; and securing an electron emitter to the support mount such that the electron emitter is thermally isolated from the support mount, wherein the step of securing comprises:

disposing at least two heat resistant elements along an outer surface of the electron emitter; and applying a compressive force to the heat resistant elements so as to retain the electron emitter to the support mount.

31. The method of claim 30, wherein the compressive force is applied by securing a clamp to the support mount.

32. The method of claim 31, wherein the electron emitter comprises a planar emitter comprising a refractory metal foil.

33. The method of claim 30, wherein the disposing step comprises the steps of: providing the heat resistant element as an elongate member comprising a material having a low thermal conductivity relative to the support mount; and disposing the elongate member along an edge of the electron emitter.

34. The method of claim 30, wherein the heat resistant element comprises a ceramic.

35. The method of claim 30, wherein the heat resistant element comprises zirconium, aluminum nitrate, malite, pyrolytic boron nitride or combinations thereof.

36. The method of claim 30 wherein the disposing step comprises the step of providing a coating along an outer surface of the electron emitter.

37. The method of claim 36, wherein the coating is an electrophoretic coating.

38. The method of claim 30, further comprising the step of extending a heat resistant element through a hole formed in the electron emitter.

39. The method of claim 30, further comprising the step of disposing at least one heat resistant element within a recess.

40. A method of assembling an electron emitter, the method comprising the steps of:

providing a support mount within an evacuated enclosure of an x-ray tube; and securing an electron emitter to the support mount such that the electron emitter is thermally isolated from the support mount, wherein the step of securing comprises:

disposing a first edge of the electron emitter between a first pair of heat resistant elements;

disposing a second edge of the electron emitter between a second pair of heat resistant elements; and applying a compressive force to each pair of heat resistant elements so as to retain the electron emitter to the support mount.

41. The method of claim 40, wherein the heat resistant elements of the first pair are positioned substantially directly opposite of each other along the first edge of the electron emitter, and the heat resistant elements of the second pair are positioned substantially directly opposite of each other along the second edge of the electron emitter.

42. The method of claim 40, wherein the heat resistant elements of the first pair are positioned opposite of each other in offset positions along the first edge of the electron emitter, and the heat resistant elements of the second pair are positioned opposite of each other in offset positions along the second edge of the electron emitter.

* * * * *